US008484032B2

(12) United States Patent
Becker et al.

(10) Patent No.: US 8,484,032 B2
(45) Date of Patent: Jul. 9, 2013

(54) SYSTEM AND METHOD FOR OPERATING A SECURITY SYSTEM

(75) Inventors: Donald Edward Becker, Lakewood Ranch, FL (US); Richard Philip Tucker, Bradenton, FL (US); William Edwards, Bradenton, FL (US); Baohua Shu, Pudong Shanghai (CN); Laigui Qin, Shanghai (CN); Wei Chen, Pudong Shanghai (CN)

(73) Assignee: UTC Fire & Security Americas Corporation, Inc., Bradenton, FL (US)

( * ) Notice: Subject to any disclaimer, the term of this patent is extended or adjusted under 35 U.S.C. 154(b) by 923 days.

(21) Appl. No.: 12/248,192

(22) Filed: Oct. 9, 2008

(65) Prior Publication Data

US 2010/0094636 A1 Apr. 15, 2010

(51) Int. Cl.
*G10L 11/00* (2006.01)

(52) U.S. Cl.
USPC ..... 704/273; 340/286.05; 340/506; 340/531; 340/539.13; 340/539.22; 340/540; 340/573.1; 340/628; 340/815.69; 348/14.08; 348/143; 455/353; 455/404.1; 600/513; 704/275

(58) Field of Classification Search
USPC ..... 340/540, 531, 286.05, 506, 539.13, 340/539.22, 573.1, 628, 815.69; 348/143, 348/14.08; 455/353, 404.1; 600/513; 704/275
See application file for complete search history.

(56) References Cited

U.S. PATENT DOCUMENTS 3,969,720 A * 7/1976 Nishino ..... 340/815.69
4,531,114 A 7/1985 Topol et al.
4,816,809 A 3/1989 Kim
5,663,714 A 9/1997 Fray
5,726,634 A * 3/1998 Hess et al. ..... 340/628
6,052,052 A 4/2000 Delmonaco
6,097,289 A 8/2000 Li et al.
6,144,310 A 11/2000 Morris
6,307,482 B1 10/2001 Le Bel
6,323,780 B1 11/2001 Morris
6,392,692 B1 * 5/2002 Monroe ..... 348/143

(Continued)

FOREIGN PATENT DOCUMENTS

EP 0034562 A 8/1981
EP 0034562 A2 8/1981

(Continued)

OTHER PUBLICATIONS

Patent Cooperation Treaty, International Search Report, Dec. 7, 2009, 7 pages, European Patent Office.

(Continued)

*Primary Examiner* — Michael Colucci
(74) *Attorney, Agent, or Firm* — MH2 Technology Law Group LLP

(57) ABSTRACT

A system and method for operating a security system include a device control module configured for electronic communication with a plurality of devices and a user interface coupled in electronic communication with the device control module. The user interface includes a voice memory and a first speaker. The user interface is configured to receive a first system event from the device control module identifying a first condition detected by the security system. The user interface is further configured to retrieve a voice message from the voice memory corresponding to the first system event and transmit the voice message via the first speaker.

20 Claims, 3 Drawing Sheets

U.S. PATENT DOCUMENTS

| | | | | |
|---|---|---|---|---|
| 6,469,732 | B1 * | 10/2002 | Chang et al. | 348/14.08 |
| 6,522,248 | B1 | 2/2003 | Andres et al. | |
| 6,553,100 | B1 | 4/2003 | Chen et al. | |
| 6,591,239 | B1 * | 7/2003 | McCall et al. | 704/275 |
| 6,600,424 | B1 | 7/2003 | Morris | |
| 6,624,750 | B1 * | 9/2003 | Marman et al. | 340/506 |
| 6,784,798 | B2 | 8/2004 | Morris | |
| 6,873,254 | B2 | 3/2005 | Andres et al. | |
| 6,970,077 | B2 | 11/2005 | Johnson et al. | |
| 7,026,926 | B1 | 4/2006 | Walker, III | |
| 7,046,985 | B2 | 5/2006 | Seales et al. | |
| 7,158,040 | B2 | 1/2007 | Morris | |
| 7,277,018 | B2 * | 10/2007 | Reyes et al. | 340/573.1 |
| 7,433,672 | B2 * | 10/2008 | Wood | 455/404.1 |
| 7,460,020 | B2 * | 12/2008 | Reyes et al. | 340/573.1 |
| 7,528,700 | B2 * | 5/2009 | Picard et al. | 340/286.05 |
| 7,936,262 | B2 * | 5/2011 | Derrick et al. | 340/539.13 |
| 2003/0025599 | A1 * | 2/2003 | Monroe | 340/531 |
| 2003/0179090 | A1 * | 9/2003 | Morris | 340/540 |
| 2005/0007451 | A1 * | 1/2005 | Chiang | 348/143 |
| 2005/0113059 | A1 * | 5/2005 | Hubbard | 455/353 |
| 2005/0143671 | A1 * | 6/2005 | Hastings et al. | 600/513 |
| 2005/0231349 | A1 | 10/2005 | Bhat | |
| 2006/0132303 | A1 * | 6/2006 | Stilp | 340/539.22 |
| 2008/0048852 | A1 | 2/2008 | Weston et al. | |
| 2008/0198006 | A1 | 8/2008 | Chou | |

FOREIGN PATENT DOCUMENTS

| | | | |
|---|---|---|---|
| EP | 1862980 | A2 | 12/2007 |
| EP | 1862980 | A2 | 12/2007 |
| GB | 2328769 | A | 3/1999 |
| GB | 2328769 | A | 3/1999 |
| GB | 2388994 | A | 11/2003 |
| GB | 2388994 | A | 11/2003 |
| WO | 2007/078544 | A2 | 7/2007 |
| WO | WO2007078544 | A2 | 7/2007 |

OTHER PUBLICATIONS

EPO Communication Pursuant to Article 94(3) EPC (Office Action) dated Feb. 15, 2012, EP Application No. 09 792 311.4, (5 pages).

* cited by examiner

SYSTEM AND METHOD FOR OPERATING A SECURITY SYSTEM

FIELD OF THE INVENTION

The embodiments described herein relate generally to configuring and operating security systems and, more particularly, to a system and method for providing pre-recorded voice messages from a user interface of the security system.

BACKGROUND OF THE INVENTION

Many facilities are provided with security systems that include monitoring and detection devices distributed throughout the facility in electronic communication with one or more device control modules. Known security systems include a user interface module in electronic communication with each device control module. The user interface module facilitates configuration and control of the security system by a user.

When a condition is monitored or detected, known security systems may be configured to provide audible notification using defined tone or buzzer patterns associated with a type of the detected condition. Such tone or buzzer patterns typically are defined by regional regulatory authorities. For example, the National Fire Protection Association's Code ("NFPA") 72 requires a detected fire condition giving rise to an evacuation condition to be signaled by a repeating pattern of three half-second on, half-second off tones and a one-and-a-half second pause. Other tone patterns may be generated with the same tone or buzzer sound to signal other types and degrees of detected condition. Unfortunately, the similarity of the patterns for many types of detected conditions, combined with the relatively rare occurrence of serious emergency conditions in the average system operator's experience, increase a difficulty for the average system operator in determining which type of detected condition corresponds to a given tone pattern. This increases a response time of the system operator and also increases a difficulty in responding appropriately.

Known detectors have included pre-recorded voice messages that play in addition to the tone patterns when the detector senses certain conditions in order to communicate with building occupants. A deficiency of such known detectors is that each detector is able to produce an audible voice message notification only in its own local area. Further, each detector is limited in an ability to synthesize detected conditions with similar information from other detectors and coordinate the information to select a properly responsive pre-recorded voice message notification. Known detectors and security systems do not address facilitating communications with a system operator. Still further, after such known detectors are installed, it has not been efficient to update or modify on-site the set of pre-recorded voice messages available from each detector; the otherwise-functional detectors generally must be disassembled and reassembled with new parts, or replaced with a new detector pre-loaded with the desired new set of voice messages.

Accordingly, it is desirable to provide a system and/or a method that facilitates an automatic selection and provision of an appropriate pre-recorded notification voice message at the user interface, based on information available from multiple monitoring and detection devices associated with the system. It is also desirable to provide a system and/or a method that facilitates an efficiency of updating or modifying the available set of pre-recorded voice messages on-site without a need to modify or replace installed detectors.

BRIEF DESCRIPTION OF THE INVENTION

In one aspect, a security system is provided. The system includes a device control module configured for electronic communication with a plurality of devices and a user interface coupled in electronic communication with the device control module. The user interface includes a voice memory and a speaker. The user interface is configured to receive a first system event from the device control module identifying a first condition detected by the security system. The user interface is further configured to retrieve a voice message from the voice memory corresponding to the first system event and transmit the voice message via the speaker.

In another aspect, a method for operating a user interface of a security system is provided. The method includes receiving a first system event from a device control module identifying a first condition detected by the security system. The method also includes retrieving from a voice memory of the user interface a voice message corresponding to the first system event and transmitting the voice message via a speaker of the user interface.

In still another aspect, a computer program embodied on a computer-readable medium is provided. The computer program includes a code segment that configures a processor to receive a first system event from a device control module of a security system. The system event identifies a first condition detected by the security system. The code segment also configures the processor to retrieve from a voice memory a voice message corresponding to the first system event and transmit the voice message via a speaker.

BRIEF DESCRIPTION OF THE DRAWINGS

FIG. 1 is a block diagram of an exemplary user interface module.

FIG. 2 is a block diagram of an exemplary security system with which a user interface module such as that shown in FIG. 1 may be used.

FIG. 3 is an exemplary embodiment of a method for providing pre-recorded voice messages from a user interface, such as that shown in FIG. 1, of a security system, such as that shown in FIG. 2.

DETAILED DESCRIPTION OF THE INVENTION

The method and system described herein facilitate operation of security systems. Such security systems include a plurality of devices in electronic communication with one or more device control modules, and a user interface module in electronic communication with the one or more device control modules. The security system is configured to generate a system event in response to any detected condition relating to security, an internal fault of the security system, or other occurrence. The user interface receives the system event and selects from its memory an appropriate pre-recorded voice message corresponding to the detected condition. The user interface then transmits the pre-recorded voice message through a speaker. The memory in which a set of available pre-recorded voice messages is stored is configured for easy replacement on-site. A technical effect of the system and method described herein is to improve a speed with which a user can recognize a type of condition detected, reduce a potential for human error, and improve an efficiency with which a new set of available voice messages can be installed on an operational security system.

At least one embodiment is described below in reference to its application in connection with and operation of a system for security monitoring, alarming, and notification. However, it should be apparent to those skilled in the art and guided by the teachings herein provided that the invention is likewise applicable to any suitable system requiring the provision of pre-recorded voice messages corresponding to system events.

Figure 1:
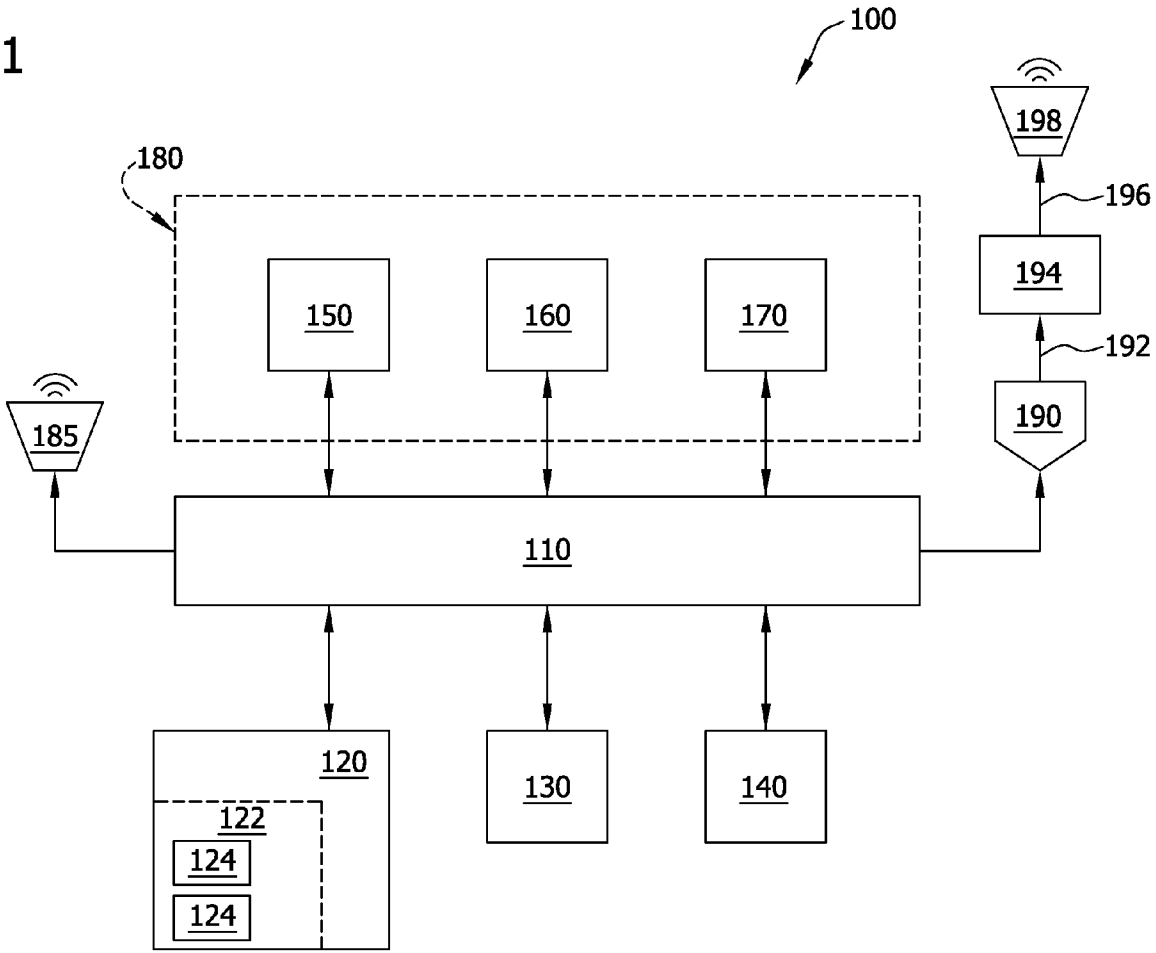
FIGS. 1-3 show exemplary embodiments of the system and method described herein.

FIG. 1 is a block diagram of an exemplary user interface module 100. In the exemplary embodiment, user interface module 100 includes a processor 110 in electronic communication with a memory 120. As used herein, the term processor is not limited to just those integrated circuits referred to in the art as a computer, but broadly refers to a microcontroller, a microcomputer, a programmable logic controller (PLC), an application specific integrated circuit, and other programmable circuits, and these terms are used interchangeably herein. In the embodiments described herein, memory 120 may include, but is not limited to, a computer-readable medium, such as a random access memory (RAM), and/or a computer-readable non-volatile medium, such as flash memory. Alternatively, a floppy disk, a compact disc-read only memory (CD-ROM), a magneto-optical disk (MOD), and/or a digital versatile disc (DVD) may also be used. Memory 120 may store and transfer information and instructions to be executed by processor 110. Memory 120 also may be used to store and provide temporary variables, static (i.e., non-changing) information and instructions, or other intermediate information to processor 110 during execution of instructions by processor 110. Instructions that are executed include, but are not limited to, resident security system control commands. The execution of sequences of instructions is not limited to any specific combination of hardware circuitry and software instructions. Also as used herein, the term electronic communication refers both to electronic communication that occurs over a direct physical connection, such as over a wire or fiber-optic cable, and to electronic communication that occurs in whole or in part over a wireless connection.

Memory 120 includes a voice memory 122 for storing a set of pre-recorded voice messages 124. Although only two voice messages 124 are shown in FIG. 1, any number of voice messages 124 may be stored in voice memory 122. In certain embodiments, voice memory 122 resides in the same physical medium as other portions of memory 120. In alternative embodiments, voice memory 122 resides on a separate physical medium from other portions of memory 120. Further, in certain embodiments, voice memory 122 resides on a physical medium that is readily detachable and attachable to user interface 100 to facilitate replacement of the set of available pre-recorded voice messages 124. For example, but not by way of limitation, voice memory 122 may reside on a medium including pins that are received in sockets on processor 110 such that voice memory 122 may be attached to, or detached from, processor 110 by hand.

In the embodiment shown in FIG. 1, processor 110 also is in electronic communication with one or more interfaces 130 that provide communication with security system hardware (not shown). In addition, processor 110 may be in electronic communication with one or more interfaces 140 that provide communication to other user interface modules 100, remote monitoring and control stations, and/or any other appropriate external module (not shown). In certain embodiments, interfaces 140 include, but are not limited to, RS-232 interfaces, RS-485 interfaces, corporate local area network (LAN) or Wide Area Network (WAN) interfaces, and/or Internet interfaces. User interface module 100 also provides for direct user input and monitoring via a keypad 150, a display screen 160, and a plurality of indicating lamps 170, all of which are in electronic communication with processor 110. In one embodiment, keypad 150, display screen 160 and indicating lamps 170 are located on a front panel 180 of user interface module 100. Also, in the embodiments described herein, additional input channels to processor 110 may include, without limitation, computer peripherals associated with an operator interface, such as a mouse, a keyboard, and/or a scanner. Further, in the exemplary embodiment, additional output channels from processor 110 may include, without limitation, an operator interface monitor output.

In certain embodiments, a first speaker 198 is configured to transmit a voice message 124 to a user near a user interface module 100. In the exemplary embodiment of FIG. 1, the set of pre-recorded voice messages 124 is stored in digitized format, and processor 110 further is in electronic communication with a digital-to-analog converter (DAC) 190. DAC 190 is configured to receive a pre-recorded voice message 124 and convert it into an analog signal 192. Analog signal 192 is amplified by an audio amplifier 194, and the amplified signal 196 is transmitted to first speaker 198. First speaker 198 thus transmits the pre-recorded voice message 124 received from processor 110 in a form that is audibly understandable to a user near user interface module 100. In alternative embodiments, pre-recorded voice messages 124 may be stored in other formats, and first speaker 198 is configured to convert those formats into forms audibly understandable to the user.

In the embodiment shown in FIG. 1, processor 110 further is in electronic communication with a second speaker 185. The second speaker 185 is configured to emit a tone or buzz at a certain frequency in response to on/off signals from processor 110. A pattern of on/off signals from processor 110 may be used to create a defined tone pattern audible to the user. For example, but not by way of limitation, processor 110 may send signals that cause second speaker 185 to generate a repeating pattern of three half-second on, half-second off tones and a one-and-a-half second pause, as required by NFPA 72 for a detected fire condition giving rise to an evacuation condition. Processor 110 may cause second speaker 185 to generate other patterns that correspond to other types and degrees of detected condition. In certain embodiments, second speaker 185 is a piezoelectric speaker.

Figure 2:
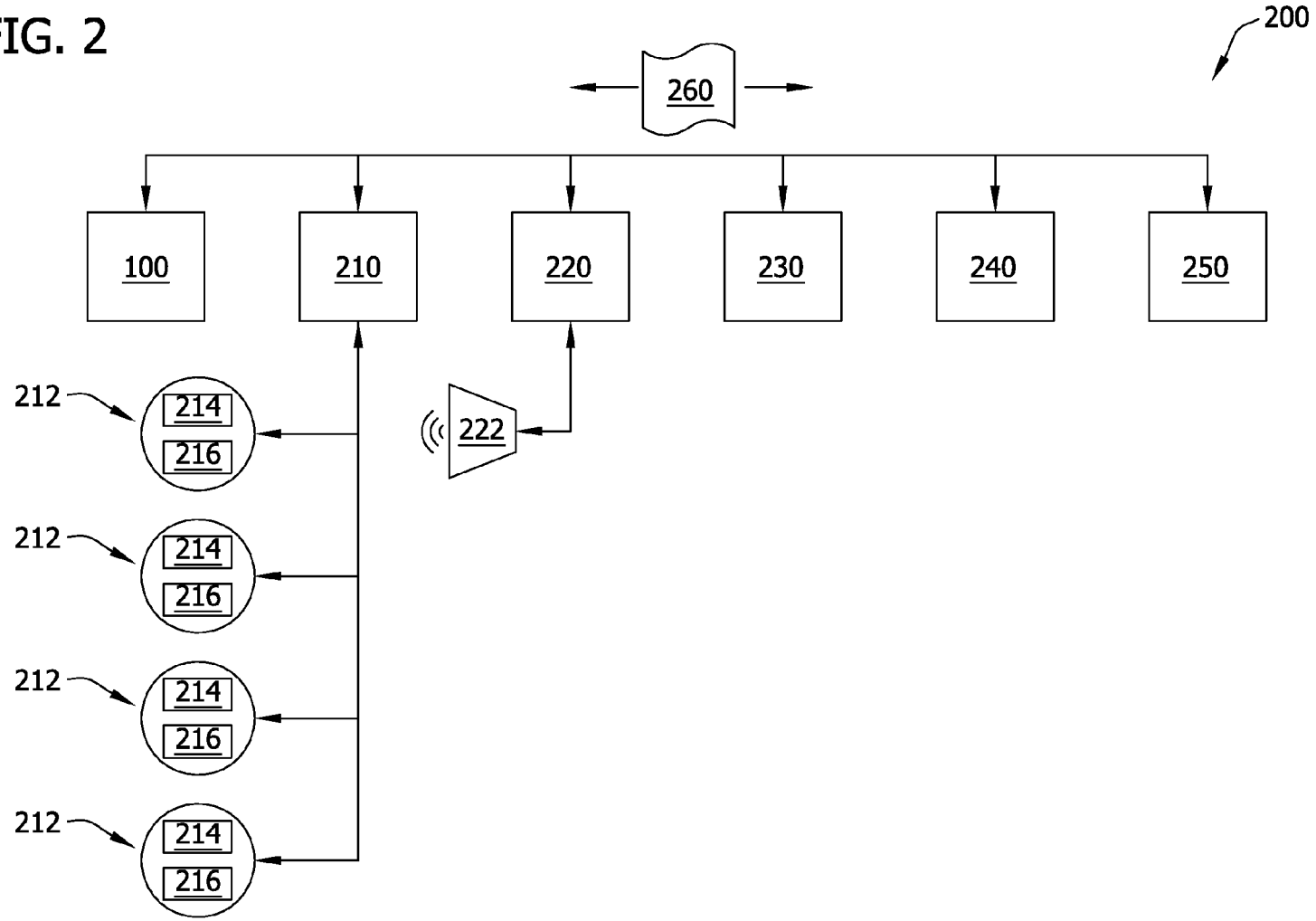

FIG. 2 is a block diagram of an embodiment of a security system 200 with which user interface module 100 may be used. User interface module 100 is in electronic communication with one or more device control modules 210. In turn, each device control module 210 is in electronic communication with a plurality of devices 212. Each device 212 may include, for example, a smoke detector, a thermal detector, a waterflow detector, a pull station, a motion detector, a door/window tampering detector, and/or any suitable fire or security detection device. Although four devices 212 are shown in FIG. 2, any number of devices 212 may be used. In certain embodiments, each device control module 210 supports up to 64 devices, 125 devices, 127 devices, 200 devices, 250 devices, 254 devices, 500 devices, or any suitable number of devices.

In one embodiment, at least one device control module 210 includes a single loop controller, and devices 212 are connected in a Class A or a Class B circuit, as defined in NFPA 72. Associated with each device 212 is a unique device address 214. In one embodiment, device address 214 of device 212 is set using a rotary dial (not shown) on device 212. In alternative embodiments, device address 214 of device 212 is set using dip switches, jumpers, or similar features (not shown) on device 212. Each device 212 has a plurality of parameters 216 associated with device 212 that should be stored within security system 200 in order for security system 200 to most effectively utilize and respond to device 212.

In the embodiment shown in FIG. 2, security system 200 also includes at least one notification module 220. Each notification module 220 provides power to and communication with annunciation and response devices (not shown) in security system 200. In one embodiment, at least one notification module 220 is configurable for standard notification appliance circuit (NAC) operation, including, but not limited to, activation of bells, horns, chimes, strobes (synchronized or non-synchronized), coded audibles (such as, but not limited to, Temporal Code 3, Marchtime, or Zone Coded), Municipal Tie, Leased Line, extinguishing agent release, and sprinkler pre-action and deluge. In certain embodiments, at least one notification module 220 is in electronic communication with at least one remote speaker 222 configured to transmit voice messages. Security system 200 also may include one or more control relay output modules 230, a power supply module 240, and one or more interface modules 250 for electronic communication with other systems (not shown).

Each of user interface module 100, device control module 210, notification module 220, control relay output module 230, power supply module 240 and additional interface modules 250 within security system 200 may be configured to generate, transmit, and/or receive a "system event" electronic communication 260 based on a particular condition detected by, or control action taken by, the module. Each system event 260 typically carries details about a triggering occurrence. Categories of system events 260 may include, but are not limited to, alarm events, security events, supervisory events, and trouble events. Each category of system event 260 may be assigned a different relative priority within security system 200. In certain embodiments, each category of system event 260 causes one indicator lamp 170 of user interface 100 to illuminate. Further, in certain embodiments, at least some categories of system events 260 cause a text message describing the event to appear on display screen 160 of user interface 100.

Figure 3:
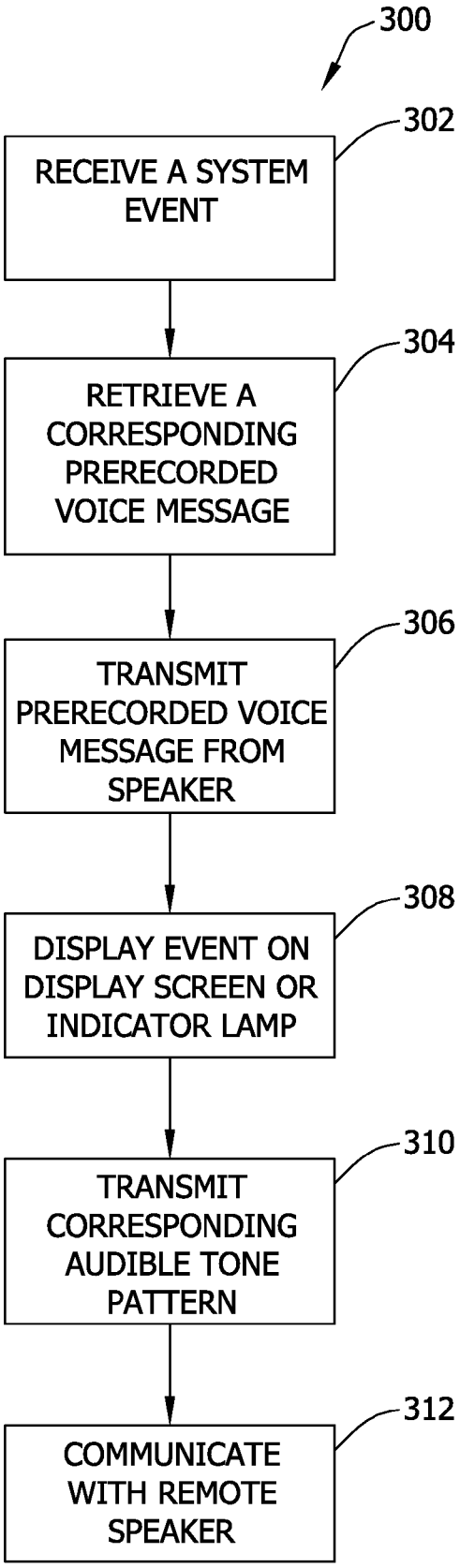

FIG. 3 is a block diagram of a method 300 for providing pre-recorded voice messages 124 from a user interface module 100 (FIG. 1) of the security system 200 (FIG. 2) according to one embodiment. Referring to FIGS. 1, 2 and 3, during normal monitoring and control operation, security system 200 automatically detects a condition and generates a system event 260 in response. User interface module 100 receives 302 the system event 260. System event 260 includes details about the type and location of the detected condition. The condition may be, but is not limited to, an evacuation alarm condition detected by a device 212, a condition bearing on security detected by a device 212, a system fault detected by diagnostic or self-monitoring functions of security system 200, an indication of non-urgent trouble from a device 212, or some other category of system event. User interface module 100 retrieves 304 from the voice memory 122 a pre-recorded voice message 124 corresponding to system event 260. Finally, user interface module 100 transmits 306 the pre-recorded voice message 124 from the first speaker 198.

In certain embodiments, user interface module 100 also displays 308 system event 260 on display screen 160 and/or indicator lamps 170. In certain embodiments, user interface module 100 further transmits 310 an audible tone pattern corresponding to system event 260 via second speaker 185. In certain embodiments, user interface module 100 synchronizes the steps of transmitting 310 from second speaker 185 and transmitting 306 voice message 124 from first speaker 198 such that voice message 124 is audible during silent periods in the tone pattern produced by the second speaker 185. Moreover, in certain embodiments, user interface module 100 electronically communicates 312 via a notification module 220 with at least one remote speaker 222.

User interface module 100 may receive more than one system event 260 in a relatively short window of time. For example, but not by way of limitation, multiple system events 260 may arrive nearly simultaneously and may contain information related to the same underlying condition and/or information containing conflicting priorities. In certain embodiments, user interface module 100 retrieves 304 an appropriate voice message 124 based on an analysis of a second system event 260 and a first system event 260. For example, and not by way of limitation, in an exemplary embodiment, if the second system event 260 has a lower priority than the first system event 260, user interface module 100 retrieves 304 a voice message 124 corresponding to first system event 260. As another example, and not by way of limitation, if the first system event 260 relates to a first wing of a monitored building and the second system event 260 relates to a second wing of the monitored building, user interface module 100 retrieves 304 a single voice message 124 corresponding to an evacuation of the entire monitored building, rather than just the first and/or second wings of the monitored building.

Additionally, in certain embodiments, voice memory 122 contains a set of voice messages 124 in which each voice message 124 contains a single statement repeated in one or more languages, and the steps of retrieving 304 and transmitting 306 a voice message 124 therefore include retrieving 304 and transmitting 306 a single statement repeated in one or more languages. For example, and not by way of limitation, a security system 200 installed in Belgium may be provided with a voice memory 122 in which each voice message 124 contains a statement in the Flemish language, followed by a substantially identical statement in the French language.

The above-described system and method for operating a security system facilitate improving user operation of the security system. More specifically, when the security system detects conditions relating to security, an internal fault of the security system, or other occurrence, the user interface module selects and transmits an appropriate pre-recorded voice message corresponding to the detected conditions. Further, the above-described system and method facilitate updating or modifying the set of available voice messages and providing the voice messages in a plurality of languages. The user interface module thus provides an immediately understandable message to a possibly inexpert user at a central location regardless of where the conditions were detected. For example, and not by way of limitation, the user may be a night clerk at the front desk of a hotel. An associated technical effect is to improve a speed with which a user can recognize a type of condition detected, reduce a potential for human error, and improve an efficiency with which a new set of available voice messages can be installed on an operational security system.

Exemplary embodiments of a system and method for operating a security system are described above in detail. The system and method are not limited to the specific embodiments described herein, but rather, components of the system and/or steps of the method may be utilized independently and separately from other components and/or steps described herein. For example, the method may also be used in combination with other security systems and methods, and is not limited to practice with only the security system as described herein. Rather, the exemplary embodiment can be implemented and utilized in connection with many other security system applications.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A security system comprising:

a device control module configured to receive detector signals from a plurality of detectors, identify occurrences of system events based on the detector signals, and provide notification signals to notification devices;

a user interface configured for electronic communication with said device control module to supervise the device control module, said user interface comprising a display, an input device, a set of pre-recorded voice messages stored in a voice memory with each voice message of the set of pre-recorded voice messages related to a category of a system event, and a first speaker at the user interface, said user interface configured to:

receive a first system event from said device control module identifying a first condition detected by said security system;

retrieve a pre-recorded voice message related to the category of system event from said set of pre-recorded voice messages stored in said voice memory corresponding to the first system event; and transmit a first repeating audible signal comprising the pre-recorded voice message corresponding to the first system event at the user interface via said first speaker; and a second speaker at an evacuation location, wherein said user interface is further configured to transmit a second repeating audible signal different from said first repeating audible signal via said second speaker and said second repeating audible signal comprises an audible tone pattern corresponding to said first system event.

2. A security system in accordance with claim 1, wherein said user interface is further configured to:

receive a second system event from said device control module identifying a second condition detected by said security system;

analyze the first system event and the second system event;

prioritize the first system event and the second system event based on the analysis of the first system event and the second system event; and retrieve a single voice message from said voice memory corresponding to the priority of the first system event and the second system event determined through the analysis.

3. A security system in accordance with claim 1, wherein said voice memory is readily detachable and attachable to said user interface.

4. A security system in accordance with claim 1, wherein said user interface further comprises a general memory, and said voice memory is physically separate from said general memory.

5. A security system in accordance with claim 1, wherein the voice message comprises a statement repeated in a plurality of languages during the first system event.

6. A security system in accordance with claim 1, wherein said second speaker is a piezoelectric speaker.

7. The security system in accordance with claim 1, wherein said user interlace is further configured to transmit, via said first speaker, said pre-recorded voice message and to not transmit said pre-recorded voice message to said second speaker at said evacuation location.

8. A method for operating a user interface configured to supervise a device control module which receives detector signals from a plurality of detectors, identifies occurrences of system events based on the detector signals, and provides notification signals to notification devices, said method comprising:

receiving user input via an input device at the user interface to monitor the control module;

receiving a first system event from the device control module identifying a first condition detected by the plurality of detectors;

retrieving from a set of pre-recorded voice messages stored in a voice memory of the user interface, with each voice message of the set of pre-recorded voice messages related to a category of a system event, a pre-recorded voice message corresponding to the category of the first system event;

transmitting a first repeating audible signal comprising the pre-recorded voice message corresponding to the first system event via a first speaker of the user interface, and displaying a text message corresponding to the first event on a display of the user interface; and transmitting a second repeating audible signal via a second speaker at an evacuation location, wherein said second repeating audible signal is different from said first repeating audible signal and said second repeating audible signal comprises an audible tone pattern corresponding to said first system event.

9. A method in accordance with claim 8, said method further comprising:

receiving a second system event from the device control module identifying a second condition detected by the plurality of detectors;

analyzing the first system event and the second system event;

prioritizing the first system event and the second system event based on the analysis of the first system event and the second system event; and retrieving a single voice message from the voice memory corresponding to the priority based on the analysis of the first system event and the second system event.

10. A method in accordance with claim 8, said method further comprising readily detaching the voice memory from the user interface and readily attaching a replacement voice memory to the user interface.

11. A method in accordance with claim 8, wherein said retrieving a voice message further comprises retrieving the voice message from a voice memory that is physically separate from a general memory of the user interface.

12. A method in accordance with claim 8, wherein said retrieving and transmitting a voice message comprise retrieving and transmitting a voice message comprising a statement repeated in a plurality of languages during the first system event.

13. A method in accordance with claim 8, said method further comprising transmitting an audible tone pattern corresponding to the first system event via a second speaker on the user interface.

14. A method in accordance with claim 13, wherein said transmitting an audible tone pattern corresponding to the first system event via a second speaker on the user interface further comprises transmitting the audible tone pattern via a piezoelectric speaker on the user interface.

15. A computer program embodied on a computer-readable medium, said computer program comprising at least one code segment that configures a processor to:

supervise a device control module configured to receive detector signals form a plurality of detectors, identify occurrences of system events based on the detector modules, and provide notification signals to notification devices;

receive user input via an input device at a user interface to monitor the control module;

receive a first system event identified by the device control module based on the detector signals, retrieve from a set of pre-recorded voice messages stored in a voice memory, wherein each pre-recorded voice message is related to a category of a system event, a pre-recorded voice message corresponding to the category of the first system event;

transmit a first repeating audible signal comprising the pre-recorded voice message corresponding to the first system event via a first speaker at the user interface; and transmit a second repeating audible signal via a second speaker at an evacuation location, wherein said second repeating audible signal is different from said first repeating audible signal and said second repeating audible signal comprises an audible tone pattern corresponding to said first system event.

16. A computer program in accordance with claim 15, wherein the at least one code segment further configures the processor to:

receive a second system event from the device control module identifying a second condition detected by the security system;

analyze the first system event and the second system event;

prioritize the first system event and the second system event based on the analysis of the first system event and the second system event;

retrieve a single voice message from the voice memory corresponding to the priority based on the analysis of the first system event and the second system event.

17. A computer program in accordance with claim 15, wherein the at least one code segment further configures the processor to retrieve a voice message from a voice memory that is physically separate from a general memory.

18. A computer program in accordance with claim 15, wherein the at least one code segment further configures the processor to retrieve and transmit a voice message comprising a statement repeated in a plurality of languages during the first system event.

19. A computer program in accordance with claim 15, wherein the at least one code segment further configures the processor to transmit an audible tone pattern corresponding to the first system event via a second speaker.

20. A computer program in accordance with claim 19, wherein the at least one code segment further configures the processor to transmit an audible tone pattern corresponding to the first system event via a piezoelectric speaker.

* * * * *